US006271629B1

(12) United States Patent
Pace et al.

(10) Patent No.: US 6,271,629 B1
(45) Date of Patent: Aug. 7, 2001

(54) MODULAR SYSTEM FOR MOVIE SET LIGHTING

(76) Inventors: Vincent Mario Pace, 11856 Moorpark St., #G, Studio Ciy, CA (US) 91604; Patrick Hugh Campbell, 25760 N. Perlman Pl., #C, Stevenson Ranch, CA (US) 91381

( * ) Notice: Subject to any disclaimer, the term of this patent is extended or adjusted under 35 U.S.C. 154(b) by 0 days.

(21) Appl. No.: 09/490,464

(22) Filed: Jan. 25, 2000

(51) Int. Cl.[7] ..... H01J 13/46

(52) U.S. Cl. ..... 315/56; 315/289; 315/312; 362/243; 362/300; 362/307

(58) Field of Search ..... 315/56, 73, 289, 315/312, 345; 362/240, 243, 223, 236, 307, 310, 351, 300, 17

(56) References Cited

U.S. PATENT DOCUMENTS 4,169,237 * 9/1979 English et al. ..... 313/1
4,423,471 * 12/1983 Gordin et al. ..... 362/96
4,536,832 * 8/1985 Lemons ..... 362/264
5,016,151 * 5/1991 Mula ..... 362/267
5,144,207 * 9/1992 Brunson ..... 315/291
5,483,424 * 1/1996 Lightbody ..... 362/17
6,068,384 * 5/2000 Tyson et al. ..... 362/153.1

* cited by examiner

*Primary Examiner*—Haissa Philogene
(74) *Attorney, Agent, or Firm*—Natan Epstein; Beehler & Pavitt

(57) ABSTRACT

Film set lighting requirements can be met with a relatively small number of lamp head modules which are assembled to any of several different reflectors to make up combinations of lighting fixtures as the need arises. The lamp head module has integral ultraviolet protection provided by a close fitting transparent lamp cover so that HMI lamps may be safely used without other UV protection on the interchangeable reflectors. An HMI lamp igniter is provided in the housing for powering different lamp wattages. The lamp head module is wired to power either incandescent or HMI lamps depending on the power cord connector used. The lamp head module is sealed for use in wet environments including underwater use.

26 Claims, 8 Drawing Sheets

MODULAR SYSTEM FOR MOVIE SET LIGHTING

BACKGROUND OF THE INVENTION

1. Field of the Invention

This invention relates generally to electric lighting fixtures and is more particularly directed to a modular lighting system having a compact lamp head module usable with different reflectors to make up various lighting fixtures such as parabolic and cycle lights. Movie set lighting requirements can be met with a relatively small number of lamp head modules which are assembled to any of several different reflectors to make up different lighting fixtures as the need arises. The lamp head module has integral ultraviolet protection provided by a close fitting transparent bulb enclosure so that HMI lamps may be safely used without other UV protection on the interchangeable reflectors. An HMI lamp igniter is provided in the housing for powering different lamp wattages. The lamp head module is wired to power either incandescent or HMI lamps depending on the power cord connector used. The lamp head module is sealed for use in wet environments including underwater use.

2. State of the Prior Art

Production of motion pictures involves the use of high power electric lights to illuminate sets and stages on which actors perform their roles. Two principal lamp technologies are used for this purpose: tungsten incandescent lamps and HMI lamps. Incandescent lamps emit light over the entire visible spectrum with little output in the ultraviolet range. HMI lamps on the other hand produce strong ultraviolet emissions which must be filtered to prevent hazardous irradiation of persons exposed to such illumination. Conventional HMI lights have metal housings with window materials such as plate glass which are opaque to ultraviolet and thus stop the harmful emissions UV.

Creative lighting of movie sets is facilitated by use of different types of light fixtures each having a characteristic light projection pattern. For wide, even illumination of backdrops or fill lighting, so called cyclorama or cyclights are commonly used. On the other hand, spot illumination is typically achieved with parabolic light fixtures. Wide, even lighting may be provided by so called soft reflectors. Still other, more specialized fixtures are also used, such as shadow boxes to provide front lighting designed to cast shadows.

Film production companies find it advantageous to rent rather than purchase equipment, and rental houses exist to provide this service. The rental of lights is a significant part of a movie production's budget, often running in the hundreds of thousands of dollars. Past industry practice among lighting rental houses has been to maintain in inventory a sufficient number of each type of light fixture to service anticipated customer needs. That is, the practice is to stock the needed number of cyclights, parabolic lights and so on.

Modern film production increasingly takes place in challenging environments, calling for lighting equipment capable of providing thousands of watts of light output safely and reliably in wet environments including occasional full immersion for filming of underwater scenes. Submersible high power lights are available, but are considered special purpose lights.

What is needed is a more versatile and economical approach to meeting the diverse lighting requirements of the movie industry.

SUMMARY OF THE INVENTION

This invention addresses the aforementioned need by providing, in one aspect of the invention, a modular lighting system comprising a lamp head module which can be interchangeably assembled to any of two or more reflectors of different geometry, to make up light fixtures having different illumination patterns, as the need may arise.

In a full featured implementation of the invention, the lamp head module supports both incandescent and HMI lamp bulbs, can be operated in dry or wet environments, and can be assembled to any of several different reflectors including but not limited to parabolic, cyclorama and soft reflectors to meet a wide range of illumination requirements with a minimum of equipment inventory.

The lamp head module has a housing, a lamp socket supported to the housing for holding a lamp, and preferably includes a lamp bulb enclosure of transparent material substantially opaque to ultraviolet radiation. The lamp enclosure has an open end fixed to the housing for enclosing a lamp socket and the lamp bulb, and an opposite closed end.

The lamp head module may be watertight including a watertight seal between the housing and the lamp bulb enclosure to make the module useful in both dry and wet environments including underwater use.

Reflector geometries may include parabolic reflectors, cyclorama reflectors, and soft reflectors. The lamp head module may include an adapter support for removably supporting the lamp head module with the lamp axis in alignment with a reflector axis. The adapter support may permit continuous positional adjustment of the lamp module along the reflector axis thereby to position the lamp bulb in relation to a focal point of the parabolic reflector or along a reflector axis of a cycle reflector. The adapter support may include a threaded ring fixed to the lamp head module housing in axial alignment with the longitudinal axis of the lamp bulb enclosure.

Support for both HMI and incandescent lamp operation may be provided by including an igniter in the module housing. A power input connector on the module housing may have two sets of input pins, one set of pins connected to the lamp socket bypassing the igniter, and the second set of pins connected for supplying power to the lamp through the igniter, such that either an HMI lamp or an incandescent lamp may be powered in the lamp socket of the module by applying electrical power to either the first or the second set of pins on the power connector.

Thermal characteristics of the lamp head module may be improved by evacuating of air the bulb enclosure and, optionally the entire module housing, or alternatively by providing an inert gas atmosphere in the bulb enclosure and the housing.

Another aspect of the invention concerns a cyclorama or cyclight fixture including a trough shaped reflector between opposite end reflectors. One or two lamp head modules may be assembled to the cyclorama reflector on a bracket assembly which supports the reflector and also releasably supports each lamp head module independently of one another with the bulb enclosure axis in generally parallel or coaxial relationship with the reflector axis.

Another aspect of this invention is a lower cost method of providing illumination on a film production set. The novel method includes the steps of providing a first number of lamp head modules, each module having a housing and a lamp socket supported to the module housing for holding and powering a lamp, providing a second number of parabolic reflectors each having a reflector axis, providing a third number of cyclic reflectors each having a reflector axis, assembling a desired number of parabolic light fixtures and cycle light fixtures by combining some or all of the lamp head modules with corresponding reflectors selected from the second number of parabolic reflectors and the third number of cyclic reflectors, and electrically powering the assembled lamp head modules for illuminating the movie set, so that the lamp head modules may be placed in service interchangeably as either parabolic light fixtures or cycle light fixtures thereby to reduce the total cost of set lighting. One or more of the lamp modules may be powered without a corresponding reflector also for illuminating the movie set. Still other types of reflectors may be assembled to the lamp head modules to thereby extend the range of light fixtures obtainable with the modular system of this invention. The method may also include the further steps of supporting and powering either an incandescent or an ultraviolet emitting lamp such as an HMI lamp in the lamp socket and providing each of the lamp head modules with an ultraviolet protective cover over the lamp such that the lamp modules may be safely used without other ultraviolet protection associated with the reflectors.

The method may further include the steps of disassembling one of more of the light fixtures by separating the lamp head module from a corresponding reflector of first geometry and assembling the same lamp head module to a reflector of different geometry thereby to make a light fixture having different illumination characteristics.

These and other features, benefits and improvements will be better understood by reference to the following detailed description of the invention taken in conjunction with the accompanying drawings.

DETAILED DESCRIPTION OF THE PREFERRED EMBODIMENTS

Figure 1:
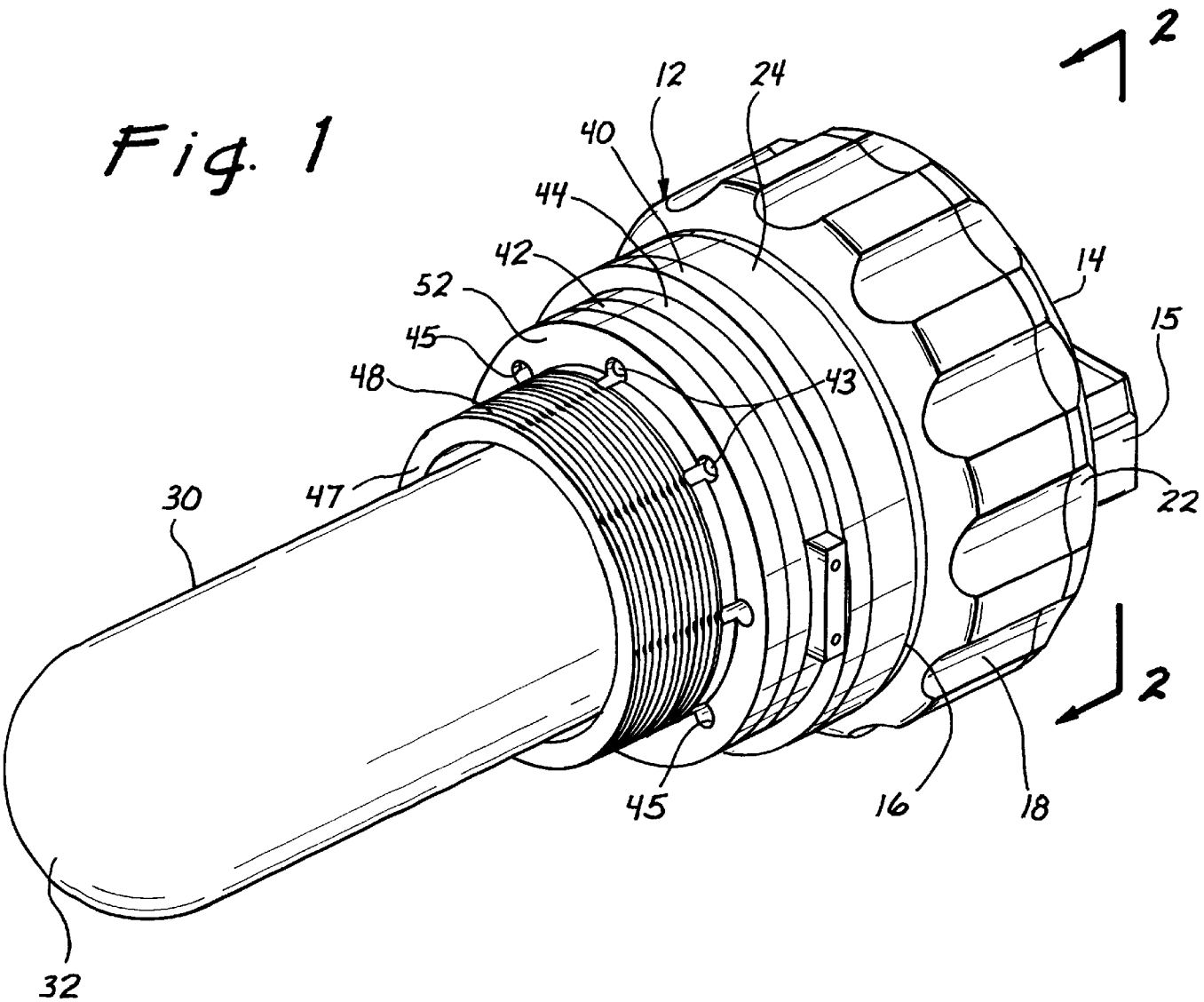
FIG. 1 is a perspective view of a lamp head module according to this invention.

With reference to the drawings wherein like numerals designate like elements, FIG. 1 shows a lamp head module (hereafter LHM) according to this invention, generally designated by the numeral 10. The LHM 10 has a module housing 12 which, for example, is machined out of aluminum for good heat conductivity, light weight and corrosion resistance.

Figure 2:
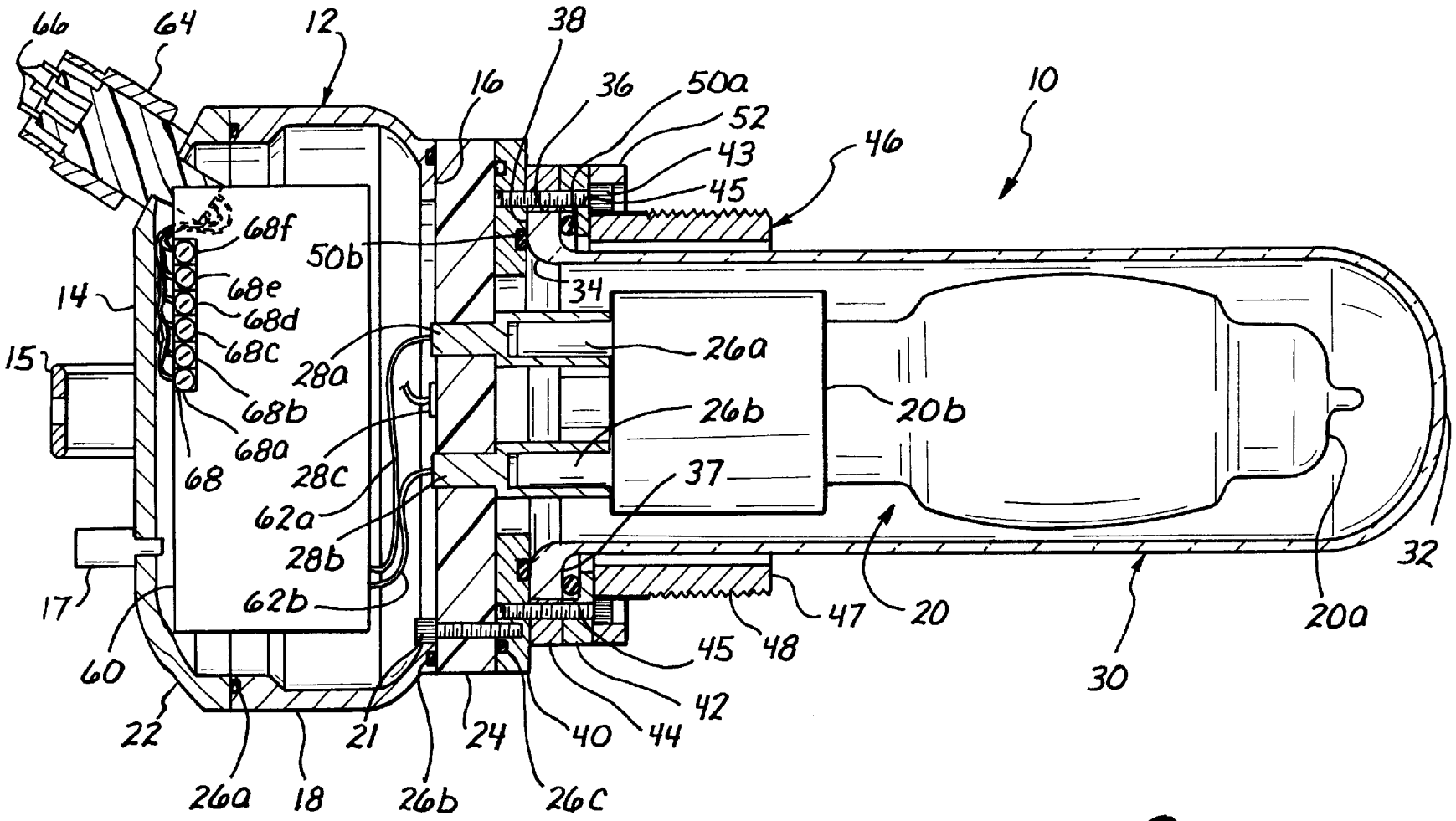
FIG. 2 is an axial cross section of the lamp head module taken along line 2—2 in FIG. 1.
Figure 3:
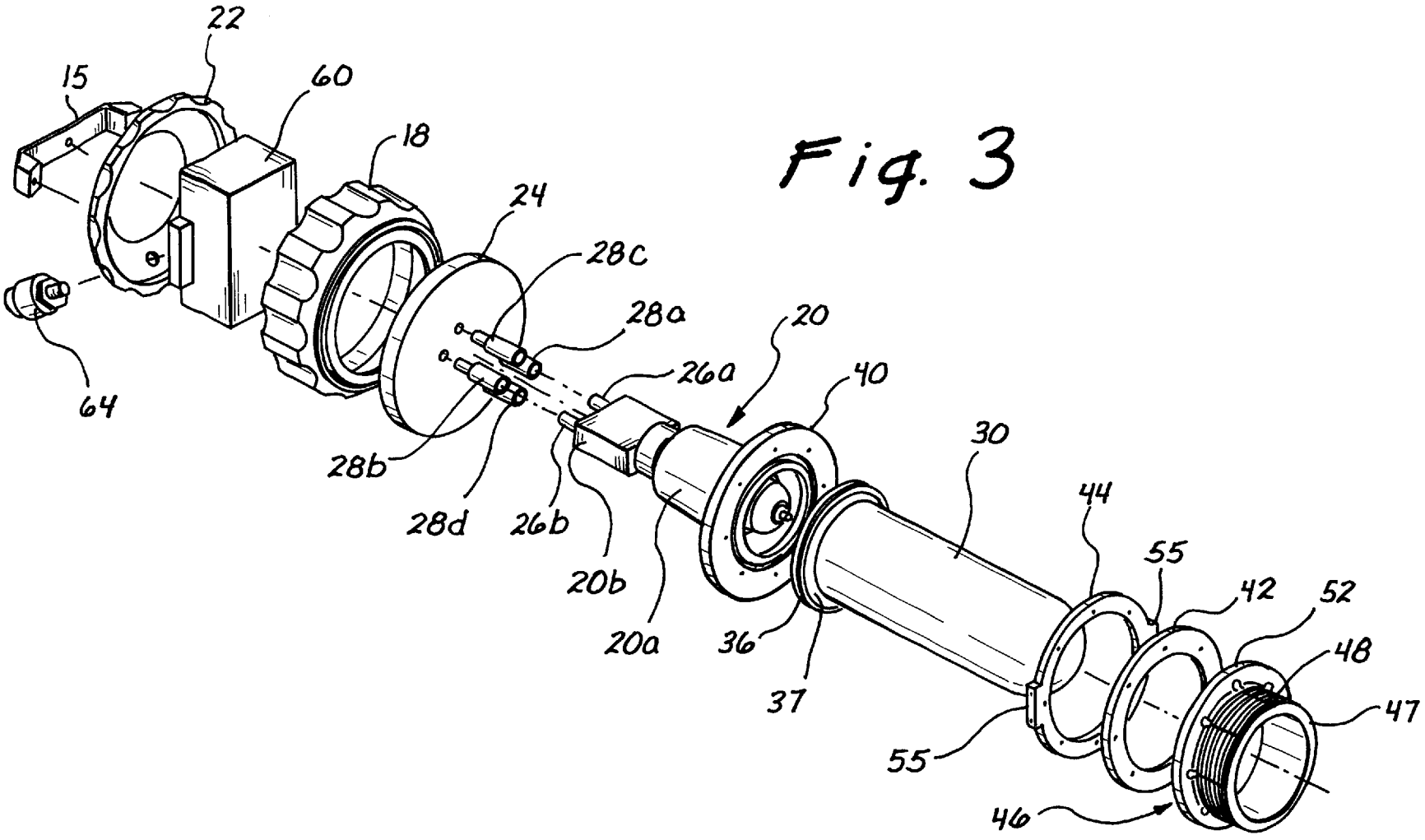
FIG. 3 is an axially exploded perspective view of the lamp head module of FIG. 1.

The module housing 12 has a rear 14 and a front 16. As better seen in the cross sectional view of FIG. 2 and the exploded view of FIG. 3 the housing has a generally annular body 18 which is closed on its rear side by a cover 22. A handle 15 is attached to the cover 22. The front of the housing body 18 is closed by an insulator disk 24 made of a suitable thermally and electrically insulating heat resistant material, such as Teflon. The rear cover 22 and the insulating disk 24 are sealed to the housing body 18 by gasket seals 26*a*, 26*b* and 26*c* to make the module housing waterproof. Two pairs of pin sockets 28*a*–28*b* and 28*c*–28*d* pass through the insulator disk 24, each pair capable of holding a lamp 20. The lamp may be either a tungsten incandescent lamp or an HMI lamp, and has a glass lamp bulb 20*a* and a ceramic lamp base 20*b* with two metallic base pins 26*a*, 26*b* which can mate into either pair of pin sockets 28*a*–28*b*, or 28*c*–28*d* respectively. A typical lamp 20 is shown supported in pin sockets 28*a*–28*b* in FIG. 2. The lamp bulb 20*a* has a center axis perpendicular to the insulator disk 24 and also generally coaxial with the housing body 18. An enclosure 30 of transparent heat resistant material such as Pyrex glass which fully envelops and covers the lamp 20. The lamp enclosure 30 has an inside diameter and a length only slightly greater than the diameter and length of the largest lamp bulb to be used in the lamp head module, as shown in the cross-section in FIG. 2. The lamp enclosure 30 is also largely opaque to ultraviolet radiation, a characteristic of Pyrex glass. The enclosure 30 is cylindrical between a closed front end 32 and an open rear end 34 defined by a radial base flange 36 of radius greater than the cylindrical portion of the enclosure 30. The base flange 36 has an annular end surface 38 which is transverse to the longitudinal axis of the cylindrical enclosure and is seated on a base ring 40. The base flange 36 is held captive in an interference fit between the base ring 40 and a retaining ring 42. The interior of the lamp bulb enclosure is sealed to the exterior environment by front and rear gasket seals 50*a*, 50*b* respectively, seen in FIG. 2. Each gasket seal includes a gasket ring of resilient compressible material held in an annular groove under axial compression, providing a face-type seal on a front face 37 and on the end surface 38 of the flange 36. A mounting ring 44 encompasses the base flange 36 and is also axially captive between base ring 40 and retaining ring 42 and also serves as a spacer between the base and retaining rings to limit compression of the seal gaskets 50*a*, 50*b* against the flange 36. Finally, an adapter ring 46 is fastened to the front side of retaining ring 42. The adapter ring includes a cylindrical sleeve portion 47 with an exterior screw thread 48 and an adapter flange 52. The several rings 40, 44, 42 and 52 are held in axial assembly by means of screws 43 passing through aligned screw holes 45 spaced around the circumference of each of these rings. The insulator disk 24 is secured to the housing body 18 by several internal screws 21 spaced around the circumference of the housing and passing through corresponding holes in the insulation disk and threaded into blind holes in the rear face of ring 40, as shown in FIG. 2, so that these internal screws are not exposed to the exterior environment.

In a presently preferred embodiment of the invention the lamp head module has an overall length Of 16.8 inches, a housing diameter of about 7 inches, and the lamp enclosure 30 is approximately 10.5 inches in length with a diameter of about 3.25 inches.

Having just described the mechanical assembly of the lamp head module 10, its electrical configuration will now be explained. The lamp head module in its preferred full featured configuration is intended to burn either incandescent lamps or HMI lamps. These two light sources provide most of the artificial illumination used in the motion picture industry. HMI lamps have a higher color temperature, i.e., HMI lamps emit a light spectrum which more closely approaches natural daylight or sunlight. Incandescent tungsten lamps on the other hand emit a cooler color spectrum, less intense in the blue end of the visible spectrum than HMI lamps, and are typically used in combination with color filters which cut some of the yellow and red light from the tungsten lamp output in order to correct or balance the light to more closely resemble the daylight spectrum. The color filters used for this purpose, so called gel filters, also cut the total intensity of the light transmitted by the gel filter. Consequently, in order to provide a given level of balanced illumination a considerably higher wattage of unfiltered incandescent lamp output is needed. A rule of thumb in the industry is that between 3 and 4 watts of incandescent light is needed to obtain 1 watt of daylight balanced (i.e. gel filtered) incandescent light. This means that about 3500 watts of gel filtered tungsten light are approximately equivalent to only 1000 watts of HMI light. On the other hand, tungsten lamp bulbs cost substantially less than HMI lamp bulbs, and burn between three and five times longer. The choice between these two types of lighting is made by the creative talent associated with the film production, usually in the person of the "DP" or Director of Photography. In general, the DP will try to achieve what he or she believes to be the best "look" for the available lighting budget.

Tungsten lamps can be powered directly with ordinary alternating current (A.C.) drawn from a wall outlet or produced by an electrical generator. HMI lamps, however, require an igniter device which provides a higher voltage and regulates the current through the HMI lamp. Conventional practice in the film industry has been to use light fixtures adapted to the power requirements of either incandescent of HMI lamps. This practice requires that lighting rental houses maintain in inventory two lines of light fixtures.

Figure 4:
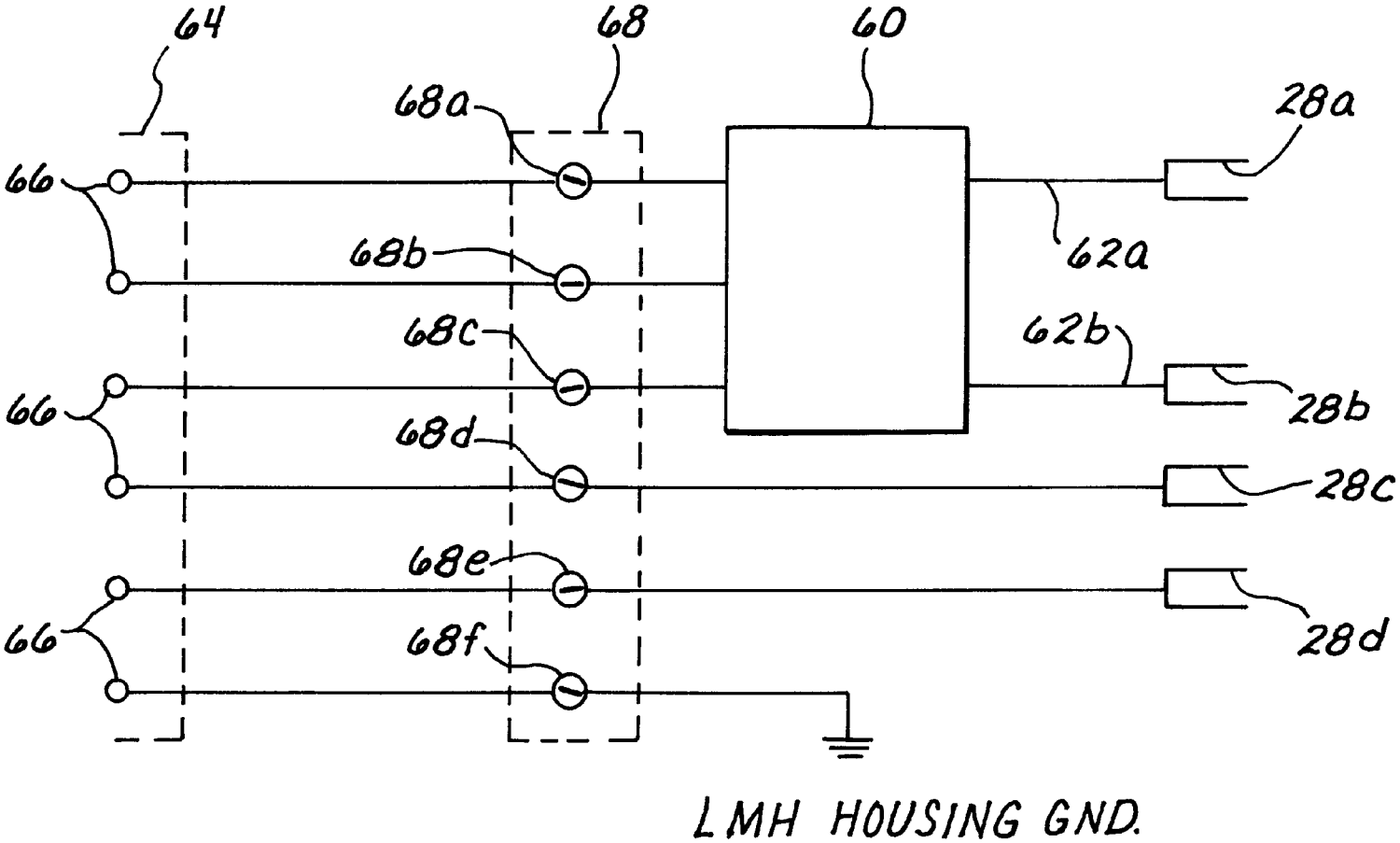
FIG. 4 is a circuit diagram of the electrical wiring of the lamp head module of FIG. 1.

The lamp head 10 of this invention overcomes this shortcoming in that the lamp head module is electrically configured for operation as either a tungsten fixture or an HMI fixture. With reference to FIG. 2, an igniter 60 in the module housing 18 has output conductors 62*a*, 62*b* electrically connected to corresponding ones of one pair of pin sockets 28*a*, 28*b*. The igniter 60 also has three input connections on terminal block 68, via terminals 68*a*, 68*b* and 68*c*, which provide two hot voltage inputs and an igniter voltage input. Power to the LHM 10 is supplied through power input connector 64 mounted on the back cover 22 of the module housing. The input connector has six connector pins 66, only three of which are visible in the cross section of FIG. 2, which mate to an electrical connector of opposite gender at the end of a power supply cable (not shown in the drawings). Three of the six pins 66 are connected to corresponding ones of the three terminals 68*a*, 68*b*, 68*c* on terminal block 68, which are in turn connected for supplying the input and igniter voltages to the igniter 60, thereby to supply power to output conductors 62*a*, 62*b* and thus to pin sockets 28*a*–28*b*. For simplicity the wiring and electrical connections are only partially shown in the cross section of FIG. 2. The electrical wiring of the LHM 10 is however shown in the circuit diagram of FIG. 4. Two other of the six pins 66 are connected to terminals 68*d* and 68*e* respectively, which in turn are connected directly to the other pair of pin sockets 28*c*–28*d*, respectively. The sixth pin 66 of the power connector is connected to terminal 68*f* and from there is connected to the metal housing 12 to provide a ground connection. In keeping with the waterproofing provided by the various gasket seals already mentioned, it is desirable that the power connector 64 be a marine grade connector which, when mated to a marine grade connector on a power supply cable, keeps the input pins 66 dry and allows wet operation of the LHM 10.

The lamp head module is convertible between incandescent and HMI lamp operation simply by installing the appropriate type lamp 20 in the corresponding pair of pin sockets 28*a,b* and 28*c,d*, and supplying power to a corresponding subset of the six input pins 66 on the power connector. This latter requirement is met by using an appropriately configured and wired mating connector on a power supply cable.

The lamp head module 10 is set up for operation as an incandescent fixture by inserting an incandescent lamp in pin sockets 28*c*, 28*d*, and applying A.C. power to a first set of two input pins 66 of power connector 64 connected to terminals 68*d* and 68*ec*. In this configuration the A.C. power bypasses the igniter 60 and is applied directly to the pin sockets 28*c*, 28*d* and thence to the base pins 20*a*, 20*b* of the incandescent lamp, thereby powering the tungsten filament of the lamp.

Operation of the LHM 10 in HMI mode is accomplished by removing the incandescent lamp bulb from pin sockets 28*c*–28*d* and installing an HMI lamp bulb 20 in pin sockets 28*a*–28*b*, and supplying suitably conditioned electrical power to terminals 68*a,b,c* through a second set of pins 66. In this HMI configuration electrical power is applied to the inputs of the igniter 60 which therefore delivers an electrical output to pin sockets 28*a*, 28*b* suitable for powering the HMI lamp.

The LHM 10 can therefore be quickly converted from an incandescent type fixture to an HMI type fixture simply by installing a lamp bulb of the desired type, and connecting a power supply cable with an appropriately configured connector for supplying power to one or the other set of the six pins 66 of power connector 64, that is, either the set of pins 66 connected to terminals 68*a,b,c* or the set of pins 66 connected to terminals 68*d,e* on power block 68. One of the pins 66, connected to the housing ground terminal 68*f*, may be used in both incandescent and HMI modes of operation and may be common to the two sets of pins.

Conversion of the LHM in this manner requires only that the lamp enclosure 30 be removed by extracting the screws 43 to free the various rings holding the lamp enclosure, exchanging the lamp bulb 20 in the pin sockets 28*a*–28*b* and 28*c*–28*d*, and replacing the lamp enclosure and ring assembly, a task which can be accomplished by a lighting technician in a short time.

The versatility of the LHM 10 is further increased by use of a multiple wattage igniter 60 obtained from D & N Labs at 1430 Willamette Street, Eugene, Oreg. 97401. This igniter can power HMI lamps of any wattage in the group of 1200 Watts, 2500 Watts and 4000 Watts, the three most commonly used HMI lamps, without any adjustment to the LHM 10 or the igniter 60. This too is a departure from the conventional industry practice of building light fixtures with a single wattage igniter so that the fixture becomes dedicated to only that one lamp bulb wattage. Operation of the LHM at different incandescent lamp wattages, such as 2000 Watts or 5000 Watts, the most common tungsten lamps, requires no more than installation of a lamp bulb 20 of desired wattage in the LHM.

Both these features, conversion between incandescent and HMI operation, and conversion between higher and lower lamp wattages, particularly HMI lamp wattages, is new in the film lighting industry. Conventional practice has been to stock sufficient numbers of light fixtures of each type and wattage to meet operating requirements of the studio or light rental house. The group of light fixtures most commonly called for in the industry are the sizes just mentioned, 1200 W, 2500 W and 4000 W HMI, and 5000 W and 2000 W tungsten. This means that five different light fixtures must be kept in inventory in order to meet a call for a particular wattage in this group. A single LHM 10, on the other hand, can meet the need for any one of these five different fixtures by no more than installation of a lamp bulb of desired type and wattage and providing appropriate power to the LHM. Since lamp bulbs are consumable items and commonly stocked in some quantity by lighting houses, the net effect is that the inventory of lighting fixtures can be cut by 80% over inventories of conventional fixtures without loss in ability to meet customer requirements by a lighting rental house. The actual benefit is in fact still greater because quite often a rental house does not have in stock some or all of the fixtures requested by a given customer. In such case the rental house either persuades the customer to take such light fixtures as may be on hand or loses that piece of business, whereas any LHM 10 according to this invention can be changed to meet the request.

The LHM 10 of this invention will be typically used in combination with one of several light reflectors of different geometry to make up any one of several types of light fixtures recognized in the film industry. Three types of reflectors fill the bulk of lighting requirements in the industry. These are the parabolic reflector, the cyclorama reflector and the soft reflector. The LHM 10 can be easily and interchangeably assembled to a reflector of any of these three types, even on location, thereby further multiplying the versatility of the modular system of this invention.

Figure 5:
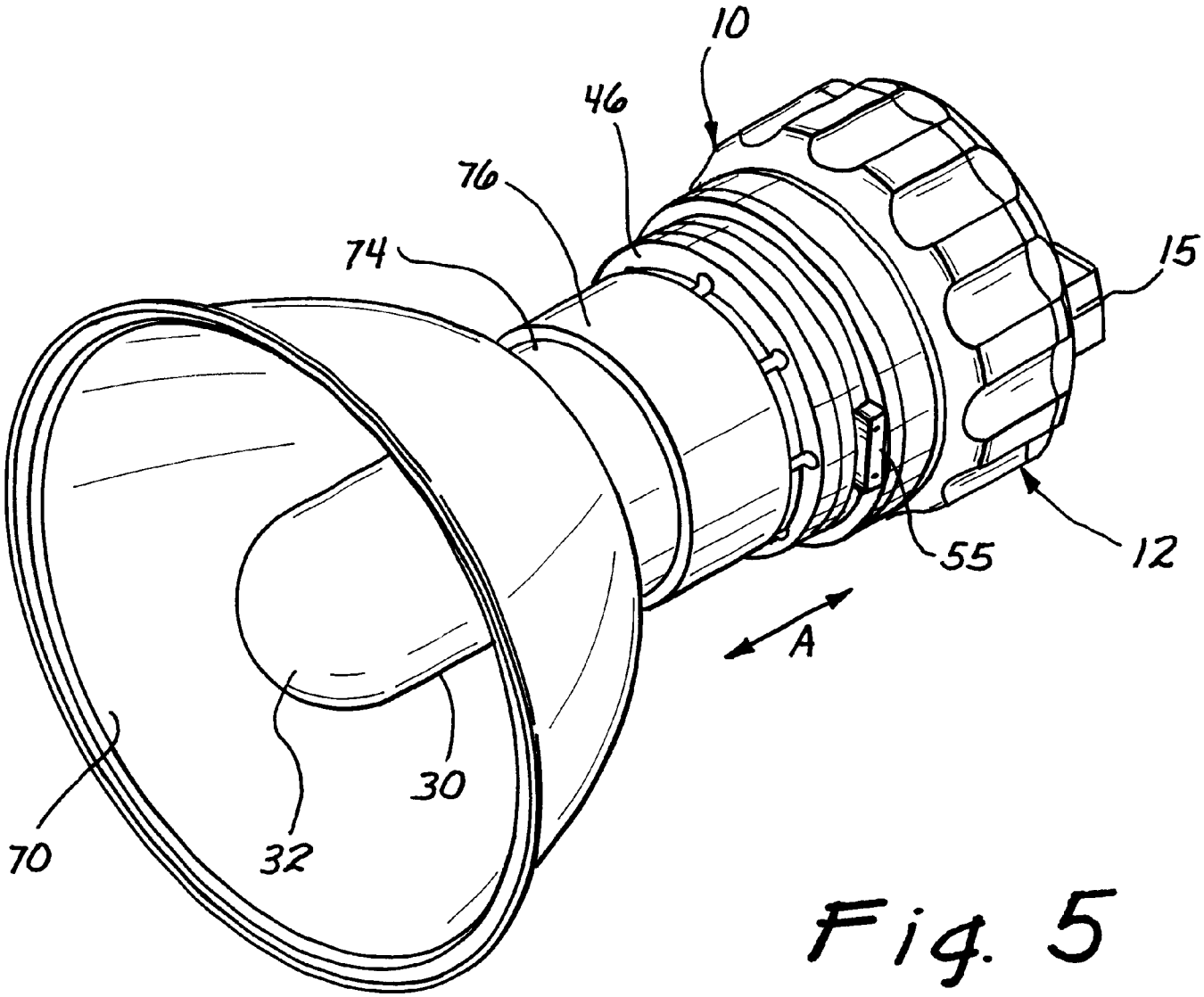
FIG. 5 is a perspective view showing the lamp head module of FIG. 1 assembled to a typical parabolic reflector.

FIG. 5 shows an LHM 10 assembled to a parabolic reflector 70 which has a reflector dish 72 with an apertured central neck portion 74 supported on a mounting ring 76. Ring 76 has an interior thread which mates to the thread 48 on the adapter ring 46 of the LHM 10. Assembly of the parabolic reflector to the LHM 10 requires nothing more than slipping the lamp enclosure 30 through the mounting ring 76 and neck 74, and screwing the ring 76 of reflector 70 onto the adapter ring 46. The threaded segment 48 on the adapter ring is preferably sufficiently long so that the reflector 70 can be moved back and forth along the adapter ring as suggested by arrow A in FIG. 5 to selectively position the lamp bulb 20 along the center axis of the reflector 70 in relation to a focal point of the reflector dish, and thereby allow adjustment of the beam width projected by the reflector 70 between narrower or spot illumination and wider beam illumination. Two diametrically opposed yoke attachment points 55 are provided on ring 44 for supporting the LHM 10 on light stands and the like.

Figure 6:
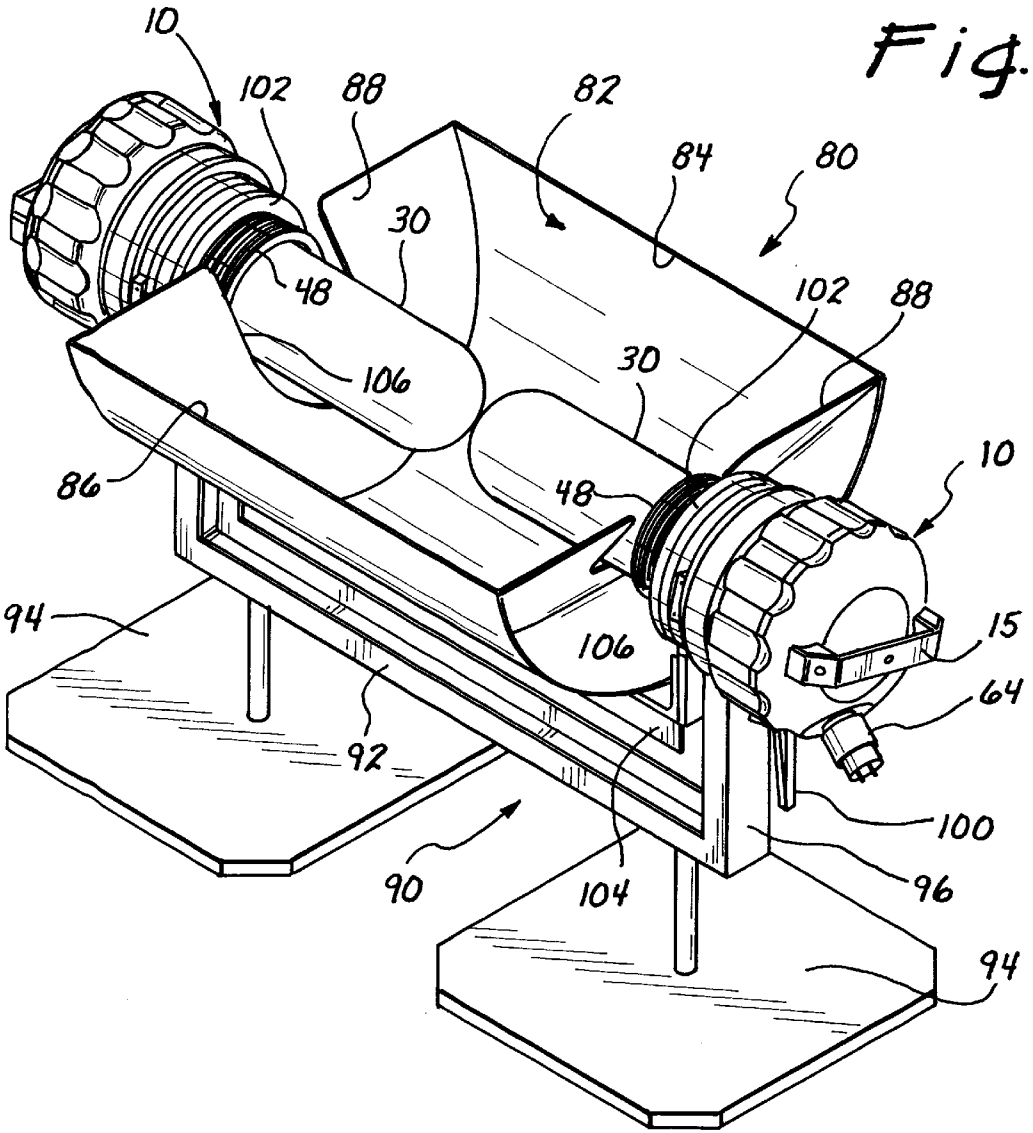
FIG. 6 is a perspective view showing a pair of lamp head modules as in FIG. 1 assembled to a typical cyclorama reflector.
Figure 7:
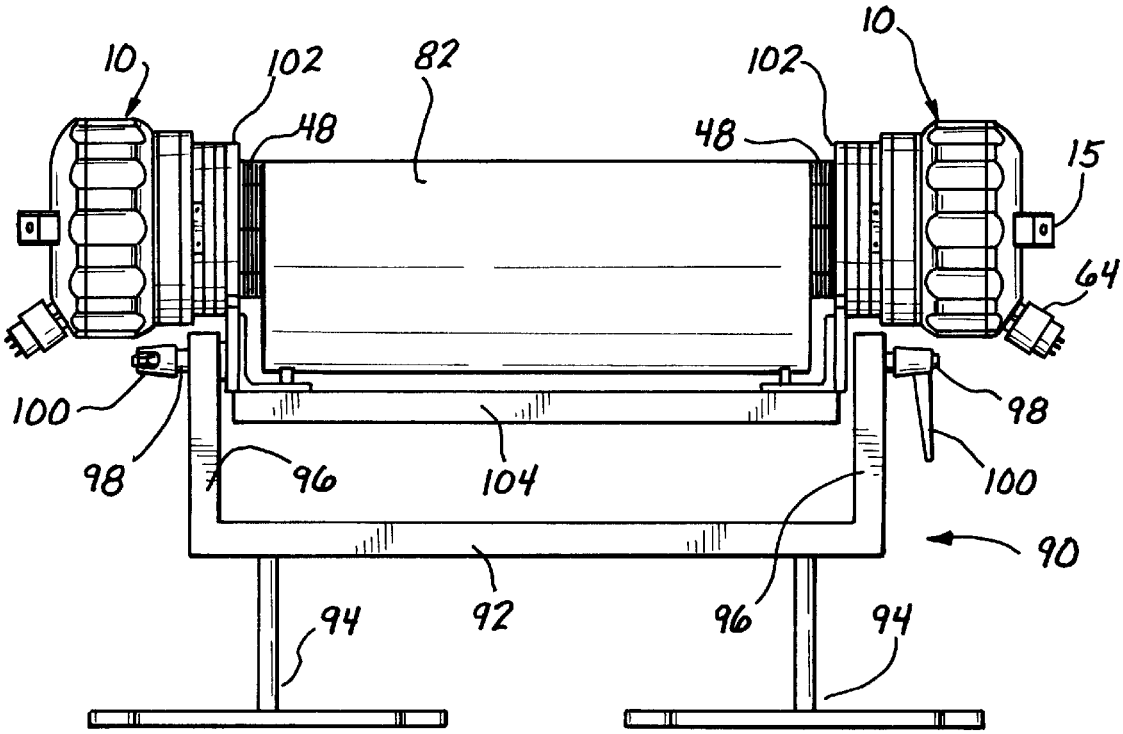
FIG. 7 is a front elevational view of the cyclorama light fixture of FIG. 6.
Figure 8:
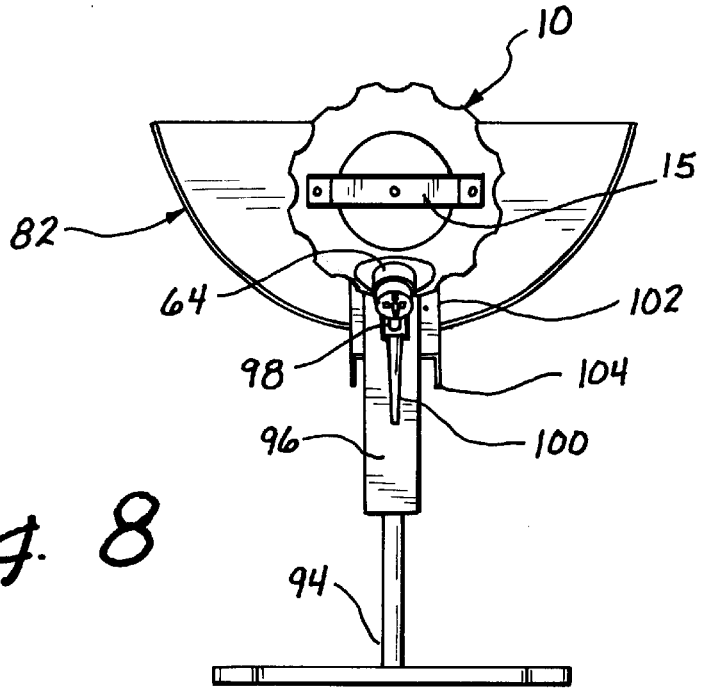
FIG. 8 is a side elevational view of the cyclorama light fixture of FIG. 6.

The LHM 10 can also be assembled to a cyclorama reflector 82 as shown in FIGS. 6 through 8 to make up a cyclorama light fixture 80 or "cyclight". Cyclorama reflectors have a reflector axis transverse to the projected beam, unlike the parabolic reflector axis which lies along the projected beam. The curvature of the cyclorama reflector between its upper edge 84 and its lower edge 86 is such that it projects even illumination on a wall surface which lies at an angle to the projected beam. Thus a cyclight near ground level can, for example, evenly illuminate a movie set backdrop surface which rises to a considerably greater height.

The cyclight 80 includes a supporting bracket generally designated by numeral 90 which supports the reflector 82 as well as one or two lamp head modules 10. The cyc' reflector 82 is generally trough shaped between upper edge 84 and lower edge 86, and between two opposite end reflectors 88. The axis of the cyc reflector is an imaginary line transverse to the end reflectors 88 and lies at a specific point between upper and lower edges 84,86. Each LHM 10 is supported on a bracket 92 with the longitudinal axis of lamp enclosure 30 parallel to or coaxial with the reflector axis. This places the lamp bulb 20 of each LHM 10 at the axis of the cyc reflector. Two LHM 10 units are assembled to the cyc reflector 82 in FIGS. 6 through 8 with the lamp enclosures 30 in end-to-end mutually coaxial relationship.

The supporting bracket 90 as best seen in FIGS. 7 and 8 has a stationary lower assembly which includes cross member 92 on two base supports 94 and a pair of upright arms 96 spaced on cross member 92. A movable upper bracket assembly is supported between upright arms 96 on pivots 98. The upper bracket assembly includes two upright carrier plates 102 each with an internally threaded opening sized to mate with the thread 48 on the adapter ring 46 of LHM 10. Each carrier plate 102 is mounted on a corresponding pivot 98 and the two plates 102 are connected to each other by upper cross member 104. Each pivot 98 has a set screw 100 which can be tightened to hold the reflector at a selected angle on the lower stationary assembly of bracket 90. Each end reflector 88 has a cut-out 106, best seen in FIG. 6, which accommodates the lamp enclosure 30 of the corresponding LHM 10 when the LHM is screwed into the respective carrier plate 102. Although a dual lamp cyclight is shown in the drawings and described above, a single lamp cyclight with a single LHM 10 unit can made by axially shortening the cyc' reflector 82 to an appropriate length.

Figure 9:
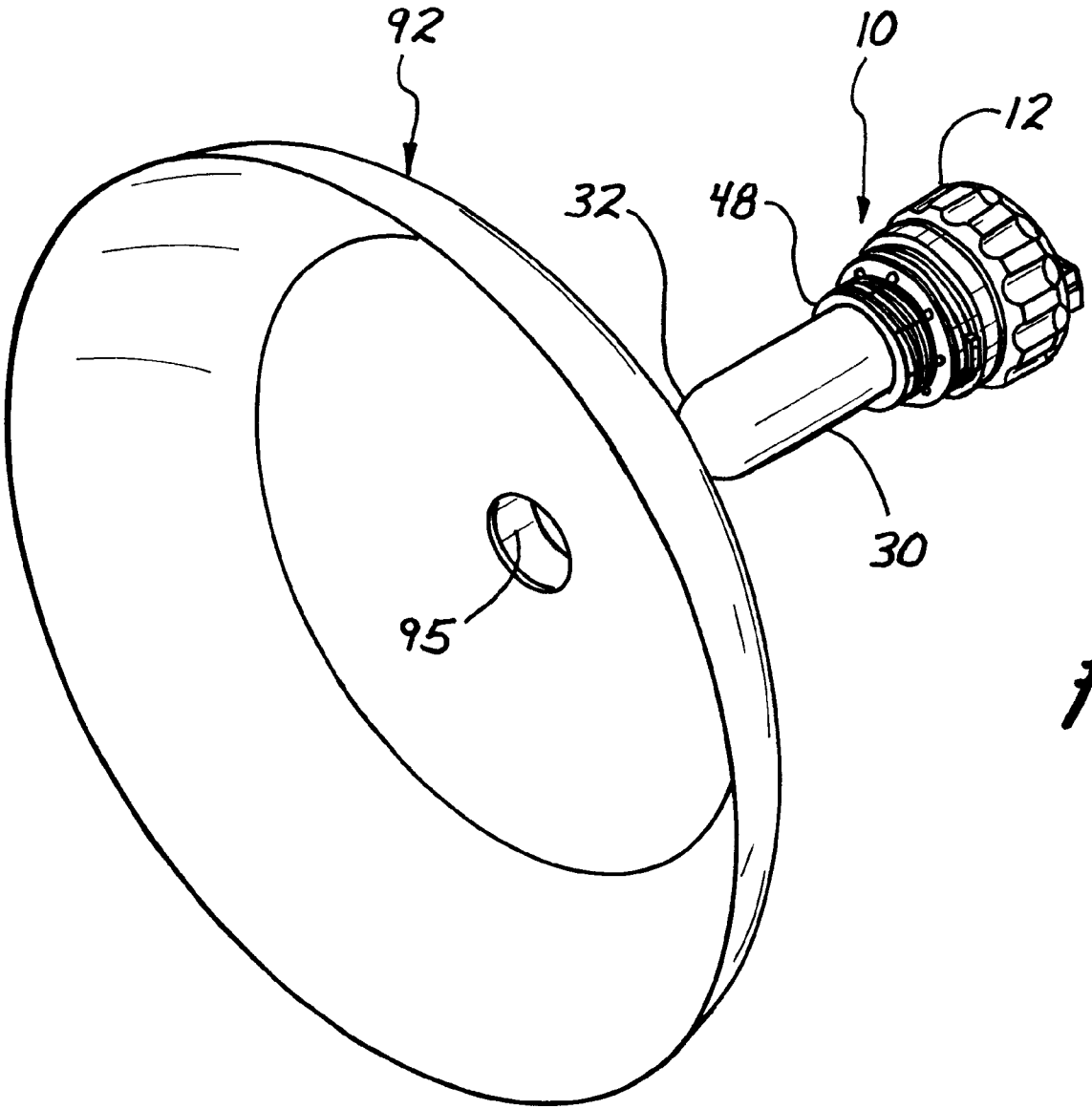
FIG. 9 is a perspective view showing a lamp head module as in FIG. 1 positioned for assembly to a typical soft reflector.

A soft reflector light fixture is assembled in a manner analogous to that described in connection with the parabolic light fixture above. The soft reflectors used in the industry are relatively large, about three feet in diameter, dish shaped reflectors. A typical soft reflector 92 is shown in FIG. 9. A LHM 10 is assembled axially to the reflector 92 by inserting the end 32 of lamp enclosure 30 and engaging the thread 48 of adapter ring 46 with a mating internal thread 95 provided on a mounting ring centered on the reflector 92.

Still other more specialized light fixtures known in the industry, with or without light reflectors, can be based on the LHM 10, such as the shadow box, a fixture designed for direct frontal illumination with the object of casting strong shadows.

Still another feature of the LHM 10 described above is that the several gasket seals provided between the housing 18, the back cover 22, lamp enclosure 30 and the various rings on the front end of the LHM 10 seal the interior of both the module housing 12 and the lamp enclosure 30 to the exterior environment, and also make the LHM 10 waterproof and operational in either a dry or a wet environment. A chief limitation to unrestricted wet and dry use of the LHM 10 is that the resilient gaskets in the various seals are susceptible to deterioration and cracking after a rated number of hours of exposure to the high operating temperatures of the LHM, so that after a period of operation in a dry environment it is prudent to at least check or preferably replace the gaskets before attempting underwater operation. Nonetheless, provided that the integrity of the gasket seals is maintained, the light fixtures based on the LHM 10 may be used without modification in either dry or wet environments, including underwater operation up the rated depth of the gasket seals. Properly implemented, these seals can make the LHM 10 watertight and submersible to depths of the order of 150 feet.

Because of the high wattages of the lamps 20 used in the LHM 10, a great deal of heat is generated and the LHM 10 operates at high temperatures. It has been found that better thermal operating characteristics of the LHM are obtained if the interior of the lamp enclosure 30 is evacuated of air. This is believed to improve heat dissipation in that air is eliminated as a thermal barrier to unimpeded radiation of heat from the lamp bulb to the lamp enclosure which transfers heat to the surrounding atmosphere or in the case of submerged operation, the surrounding body of water. Because both the lamp enclosure 30 and the module housing 12 are both sealed against the exterior atmosphere, it is easy to draw a vacuum throughout the entire interior of the LHM 10 including the enclosure 30 and the housing 12 thereby removing air as a thermal factor throughout the LHM. In lieu of a vacuum, other special atmospheres may be maintained, such as an inert gas atmosphere, selected for improved thermal characteristics over an air atmosphere during operation of the LHM 10. The maintenance of special interior environments, whether a vacuum or other-than-air atmospheres, is made possible by the sealed construction of the LHM 10. The vacuum may be drawn, or a gas injected, through a suitable valve 17 mounted through the back cover 22, as shown only in FIG. 2. Although the evacuation of the LHM interior has been found advantageous it is not an essential feature of the module 10 and the LHM can be also operated with an air filled interior. It is also not essential that the interior of the LHM 10 be sealed to the exterior environment if dry operation only is contemplated and so long as sufficient ultraviolet shielding is provided if a UV emitting lamp 20 is used.

It will be appreciated that many of the advantages of the modular lighting system disclosed above are retained even if the LHM is operated only with incandescent lamps so that ultraviolet shielding becomes unnecessary. In such case the transparent lamp enclosure 30 could be eliminated provided that the lamp bulb 20 is otherwise protected against wetting or only operated in a dry environment. In a minimal implementation of this modular lighting system designed for dry only operation with incandescent lamps only, the LHM 10 has no lamp enclosure and no other ultraviolet shielding, is not sealed to the outside environment, and has no igniter 60 which is needed only for HMI lamp operation. Yet even in this minimal implementation the head lamp module 10 can be assembled to different reflectors and can accommodate different incandescent lamp wattages to provide a substantial advance over the present industry practice which is limited to light fixtures dedicated to a particular reflector geometry and only one lamp wattage.

Although the foregoing description of the invention was made with emphasis on application to the film making industry and movie set lighting, this is not intended as a limitation to possible applications of this invention which will be found useful in many applications requiring a versatile source of high power illumination, such as the lighting of large indoors and outdoor spaces.

While a presently preferred embodiment of the invention has been described and illustrated for purposes of clarity and example, it must be understood that many changes, substitutions and modifications to the disclosed embodiment will be apparent to those having only ordinary skill in the art without thereby departing from the scope of this invention as defined in the following claims.

What is claimed is:

1. A lamp head module for assembly to a variety of light reflectors, comprising:

a housing, a transparent lamp enclosure substantially opaque to ultraviolet radiation and having an open end fixed to said housing and an opposite closed end, and a lamp socket supported to said housing for holding a lamp in said lamp enclosure;

said lamp head module being interchangeably assembled with any light reflector selected from the group comprised of a parabolic reflector, a cyclorama reflector and a soft reflector, said any light reflector being detachable from said module without separation of said lamp enclosure from said housing.

2. The lamp head module of claim 1 further comprising an igniter in said housing connected to said lamp socket; a power input connector on said housing including a first and a second pin set, said first pin set being connected for supplying power to said socket exclusive of said igniter and said second pin set being connected for supplying power to said igniter, whereby said lamp socket is operative for powering either an HMI lamp or an incandescent lamp by applying electrical power to either said first or said second set of pins of the power connector, respectively.

3. The lamp head module of claim 2 wherein said igniter is selected to power a lamp in said lamp socket of any of two or more substantially different wattages.

4. A lamp head module for assembly to a variety of light reflectors, comprising:

a housing, a transparent lamp enclosure substantially opaque to ultraviolet radiation and having an open end fixed to said housing and an opposite closed end, and a lamp socket supported to said housing for holding a lamp in said lamp enclosure;

an igniter in said housing connected to said lamp socket; a power input connector on said housing including a first and a second pin set, said first pin set being connected for supplying power to said socket exclusive of said igniter and said second pin set being connected for supplying power to said igniter, whereby said lamp socket is operative for powering either an HMI lamp or an incandescent lamp by applying electrical power to either said first or said second set of pins of the power connector, respectively.

5. The lamp head module of claim 4 wherein said transparent lamp enclosure is generally cylindrical between said closed end and said open end, a watertight seal between said open end and said housing, and an adapter ring fixed to said housing and generally coaxial with and exterior to said lamp enclosure, said adapter ring threaded for engagement to a mating thread on a light reflector, whereby a reflector may be attached or separated from the lamp head module without opening said seal between the lamp enclosure and the housing.

6. The lamp head module of claim 4 wherein said lamp head module is interchangeably assembled with any light reflector selected from the group comprised of a parabolic reflector, a cyclorama reflector and a soft reflector, said any light reflector being detachable from said module without separation of said lamp enclosure from said housing.

7. A modular lighting system comprising:

a lamp module having a housing, a transparent lamp enclosure substantially opaque to ultraviolet radiation and having an open end fixed to said housing and an opposite closed end, and a lamp socket supported to said housing for holding a lamp in said lamp enclosure;

a parabolic reflector having a reflector axis;

a cyclic reflector having a reflector axis; and means for supporting said housing interchangeably to said parabolic reflector and said cyclic reflector with said transparent lamp enclosure in alignment with said reflector axis of either reflector;

whereby said lamp module can be combined with one said reflector to make either a parabolic light fixture or a cycle light fixture.

8. The system of claim 7 wherein said lamp enclosure of the lamp module is radially unobstructed for illumination radially omni-directional to said lamp enclosure.

9. The system of claim 7 wherein said means for supporting are configured and adapted to permit continuous positional adjustment of said lamp enclosure along said reflector axis of said parabolic reflector thereby to bring a lamp supported in said socket to a focal point of said parabolic reflector and thereby to advance said lamp enclosure along said reflector axis of said cyclic reflector.

10. The system of claim 9 wherein said means for supporting comprise a threaded ring fixed to said housing axially with said lamp enclosure.

11. The system of claim 7 further comprising a water tight seal between said lamp enclosure and said housing.

12. The system of claim 7 further comprising a HMI lamp supported in said lamp socket.

13. The system of claim 7 further comprising an igniter in said housing connected to said socket; a power connector on said housing including a first and a second pin combination, said first pin combination being connected for supplying power to said socket exclusive of said igniter and said second pin combination being connected for supplying power to said igniter, whereby said socket is operative for powering either an HMI lamp or an incandescent lamp by applying electrical power to either said first or said second combination of pins on the power connector, respectively.

14. The system of claim 7 wherein said lamp enclosure is evacuated of air.

15. The system of claim 7 wherein said lamp enclosure contains an inert gas atmosphere.

16. The system of claim 7 wherein said housing and said lamp enclosure are watertight for use of said lamp module underwater.

17. The system of claim 7 wherein said lamp enclosure is cylindrical between said open end and said closed end.

18. A cycle light comprising:

a cycle reflector including a cylindrical reflector between opposite end reflectors and a reflector axis of said cylindrical reflector;

a pair of lamp modules, each lamp module having a housing, a transparent lamp enclosure substantially opaque to ultraviolet radiation and having an open end sealed to said housing and an opposite closed end, and a lamp socket supported to said housing for holding a lamp in said lamp enclosure; and a bracket assembly for releasably supporting said pair of lamp modules independently of each other with said lamp enclosure of each module in generally parallel relationship with said reflector axis;

such that said lamp modules are each separately removable from said bracket assembly for individual use apart from said cycle reflector.

19. The cycle light of claim 18 wherein said bracket assembly supports said lamp modules with said closed end of said lamp enclosure between said end reflectors and said housing outside of said end reflectors.

20. The cycle light of claim 19 further comprising a threaded ring fixed to said housing axially with said lamp enclosure and engageable with a mating thread on said bracket assembly for supporting the lamp module on the bracket assembly.

21. The cycle light of claim 20, each of said lamp modules further comprising an igniter in said housing connected to said socket; a power connector on said housing including a first and a second pin combination, said first pin combination being connected for supplying power to said socket exclusive of said igniter and said second pin combination being connected for supplying power to said igniter, whereby said socket is operative for powering either an HMI lamp or an incandescent lamp by applying electrical power to either said first or said second combination of pins on the power connector.

22. The cycle light of claim 18 wherein said housing and said lamp enclosure of each of said lamp modules are watertight for use of said lamp module in a wet environment including use underwater.

23. A lower cost method of providing illumination on a movie set, comprising the steps of:

providing a plurality of lamp modules, each module having a housing, and a lamp socket supported to said housing for holding a lamp;

providing a plurality of parabolic reflectors each having a reflector axis;

providing a plurality of cyclic reflectors each having a reflector axis;

assembling a desired number of parabolic light fixtures and cycle light fixtures by combining some or all of said lamp modules with corresponding reflectors selected from said plurality of parabolic reflectors and said plurality of cyclic reflectors; and electrically powering said some or all of said lamp modules for illuminating said movie set;

whereby said lamp modules may be placed in service interchangeably as either parabolic light fixtures or cycle light fixtures thereby to reduce the total cost of set lighting.

24. A lower cost method of providing illumination on a movie set, comprising the steps of:

providing a plurality of lamp modules, each module having a housing, and a lamp socket supported to said housing for holding a lamp;

providing additional pluralities of reflectors selected from the group comprised of parabolic reflectors, cycle reflectors, flat reflectors and soft reflectors;

assembling each of said lamp modules to corresponding reflectors selected from said additional pluralities to make up a desired assortment of modular light fixtures; and electrically powering said lamp modules for illuminating said movie set with said light fixtures;

whereby the total cost of set lighting is reduced by using a modular lighting system.

25. The method of claim 24 wherein said step of providing the lamp modules further comprises the steps of supporting and powering an ultraviolet emitting lamp in said lamp socket and providing each of said lamp modules with an ultraviolet shield over the lamp such that the lamp modules can be safely used to illuminate the movie set without other ultraviolet protection associated with said reflectors.

26. A modular method of providing lighting fixtures, comprising the steps of:

providing a plurality of lamp modules, each module having a housing, and a lamp socket covered by a lamp enclosure substantially opaque to ultraviolet;

providing a plurality of light reflectors selected from the group comprised of parabolic reflectors, cycle reflectors, flat reflectors and soft reflectors;

installing in each of said lamp modules a lamp selected from the group comprised of incandescent lamps and HMI lamps; and assembling each of said lamp modules to corresponding reflectors to make up a desired assortment of modular light fixtures.

* * * * *